United States Patent [19]

Grapin et al.

[11] 4,371,120

[45] Feb. 1, 1983

[54] PARTICLE GRINDER WITH HIGH DEGREE OF SOUND ISOLATION

[75] Inventors: Jean P. Grapin, Frontignan; Gilbert Gauthier, Belmont; Francis Deltruc, Lozanne, all of France

[73] Assignee: Ciments Lafarge France, Saint-Cloud, France

[21] Appl. No.: 212,592

[22] Filed: Dec. 3, 1980

[30] Foreign Application Priority Data

Dec. 3, 1979 [FR] France ..... 79 29686

[51] Int. Cl.[3] ..... B02C 17/18

[52] U.S. Cl. ..... 241/284; 241/182; 241/285 R; 241/DIG. 30

[58] Field of Search ..... 181/200, 205; 241/285 R, 285 A, 285 B, DIG. 30, 182, 179, 180, 181, 183, 284, 299

[56] References Cited

U.S. PATENT DOCUMENTS 3,895,761 7/1975 Mills ..... 241/285 R X
4,062,500 12/1977 Peterson, Jr. ..... 241/285 R

FOREIGN PATENT DOCUMENTS 2337163 2/1975 Fed. Rep. of Germany .
2152279 3/1973 France .
512600 9/1939 United Kingdom .
483130 12/1975 U.S.S.R. .
688219 9/1979 U.S.S.R. .

*Primary Examiner*—Mark Rosenbaum
*Attorney, Agent, or Firm*—Ernest F. Marmorek

[57] ABSTRACT

A particle grinder includes a container having at least one opening in a wall thereof; a sound isolation layer covers a major portion of the exterior surface of the container and an elongated fastening device passes through the opening, fastening the sound isolation layer to the container. The fastening device includes a bolt and a nut threadable onto the bolt. A first sleeve composed of substantially non-deformable material surrounds the elongated fastening device at least partially within a region of the opening, and a second and resilient sleeve surrounds the first sleeve, at least partially and normally projects exteriorly therebeyond. A clearance exists normally between the sleeves and the sound isolation layer abuts an exterior portion of the second sleeve. A resilient seal is disposed around the periphery of a portion of the fastening device, and between the first sleeve, and the container. An elastic washer is disposed between the sleeve, and an outer portion of the fastening device, which outer portion is arranged to axially abut against the elastic washer.

7 Claims, 1 Drawing Figure

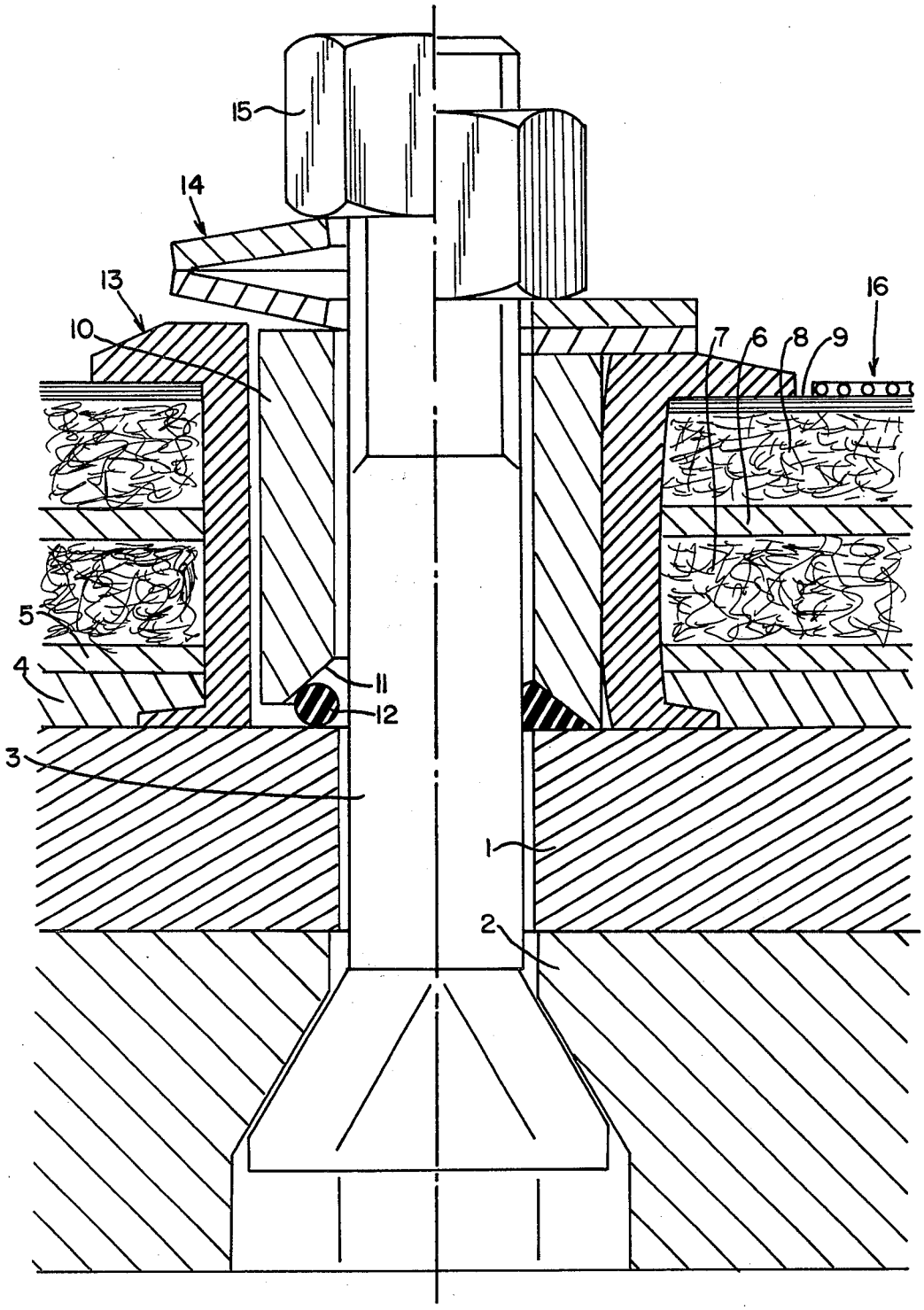
15
14
13
10
16
7
6
8
9
5
4
11
12
3
1
2

PARTICLE GRINDER WITH HIGH DEGREE OF SOUND ISOLATION

BACKGROUND OF THE INVENTION

A particle grinder is a well known apparatus which includes generally a cylindrical container which has a horizontal axis, or an axis slightly inclined to the horizontal; a shaft with an outwardly diverging truncated cone is generally disposed along the axis. The materials to be ground are introduced to the interior of the container, which is provided with a resistant interior lining, so that the material to be ground, most frequently balls or the like, can be received in the apparatus. Subsequently the apparatus is made to rotate about its axis at a speed conveniently selected so that the material to be ground is carried along with the rotation and then falls back to the substances to be ground.

Machines of this type, which are to all intents and purposes, indispensable, have, however, a disadvantage, as they are very noisy, and in certain plants, for example in cement-producing plants, they constitute the major source of noise. The relatively large dimensions of these machines in many cases makes it very expensive to noise-proof the buildings in which they are situated.

It is clearly possible to surround the container exteriorly by a certain number of layers of sound-isolating material, but it will be borne in mind that threaded bolts for keeping sheeting in place pass through the container. Moreover the sound-isolating materials are fragile and of low mechanical rigidity. They must be protected on one hand against atmospheric decontamination, and on the other hand against dust which can pass into the container by the openings through which the threaded rods or bolts pass. Experience has shown that the dust, because of the vibrating action of the machine, can accumulate in the sound-isolating material, and can rapidly make it inoperative.

Furthermore the tightening nuts of the threaded bolts must remain accessible, so as to limit the time of replacing the sheeting elements. If the nuts exert a pressure on the sound-isolating material, the sound-isolating material is crushed and poorly protected against any dust. If one desires to dispense with this sound-isolating material in the vicinity of each rod by, for example, tightening a nut near the end of a corresponding shaft, the nut must be given sufficiently large dimensions so that it can easily be handled by tightening tools, and furthermore so that a leak-proof washer can be placed around the rod, in which case any noise reduction previously obtained is severely impaired.

An improvement in lined drums of ball mills is, for example, taught by Newell, in British Pat. No. 512,600; this reference is, however, silent as to sound-proofing the device. Neither does Venot-Pic, in French Pat. No. 72.32523, which relates to linings in an oven, provide any suggestion as to how to sound-proof the drum or container of a particle grinder, ball mill, rod mill or the like. Linco, in German laid-open patent specification DT No. 23 37 163 Al relates to a fastening device designed to alleviate stresses in ovens or the like, but is not concerned with sound-proofing the oven.

The objects of the invention, relating to an improvement in a particle grinder, and lined container thereof, or in a ball mill with a lined drum will be outlined in what follows.

SUMMARY OF THE INVENTION

One of the principal objects of the invention is to devise an apparatus of this type in which the tightening of the sound isolating layer by means of threaded bolts is performed securely, and in which the threaded bolts used do not impair the sound isolating layer, so that the sound-proof quality of the layer is not impaired, and where any surfaces which transmit noise to the exterior are reduced to a minimum.

These objects are attained by a particle grinder which includes a container having at least one opening in a wall thereof. A sound isolation layer covers a major portion of the exterior surface of the container, and an elongated fastening device passes through the opening fastening the sound isolation layer to the container, and includes a bolt and a nut threadable onto the bolt. A first sleeve composed of substantially non-deformable material at least partially surrounds the elongated fastening device within a region of the opening, and a second and resilient sleeve at least partially surrounds the first sleeve, and normally projects exteriorly therebeyond. A clearance normally exists between the sleeves, and the sound isolation layer abuts an exterior portion of the second sleeve, A resilient seal is disposed around the periphery of a portion of the fastening means, and between the first sleeve and the container. Elastic means are disposed between the sleeve and an outer portion of the fastening device, so as to axially abut against the outer portion. When the nut is then tightened onto the bolt, the second resilient sleeve is compressed substantially in an axial direction through the elastic means, thereby establishing at least partial contact between an exterior peripheral portion of the first sleeve, and an interior peripheral portion of the second sleeve, so that the opening is made sound-proof.

BRIEF DESCRIPTION OF THE DRAWING

For a fuller understanding of the nature and objects of the invention, reference should be had to the following detailed description, taken in connection with the sole FIGURE of the drawing, which is a section through the apparatus of the present invention; the left portion of the FIGURE is fragmentary sectional view, including a threaded bolt passing through the apparatus when the tightening nut is loose, while the right portion is a sectional view of the apparatus, similar to the left portion but with the tightening screw in a tightened position.

DESCRIPTION OF THE PREFERRED EMBODIMENTS

In carrying the invention into effect, there will be seen in the FIGURE an elevational section of a metallic container 1 in the interior of which there are disposed protective lining elements 2. Each protective lining element 2 is formed with a recess, a part of which has substantially the shape of a truncated cone, which receives a mating portion in the form of a head of a threaded bolt 3, passing through the container 1. The exterior of the container 1 comprises sound-isolation means, which includes in the direction from the interior of the machine towards its exterior, a sound-isolation layer 4, two foils 5 and 6 alternating with two layers of foam 7 and 8 and a lining 9 of cloth or similar material to provide additional mechanical and chemical protection. This sound-isolation layer is formed with an elongated passage of circular cross section, which receives the threaded bolt 3. The threaded bolt 3 has a length exceeding the thickness of the sound-isolation layer. The threaded portion of the bolt 3 extends in a region beyond the layer 9, but does not extend quite up to the metallic container 1. The bolt 3 is surrounded by a first tubular sleeve 10, in which the bolt 3 is able to slide freely. The sleeve 10, in turn, is bevelled at one end facing the container 1, so that a recess in the shape of a truncated cone is formed therein, and a conical surface 11 faces inwardly.

An elastic annular support 12 is disposed in the conically-shaped recess between the sleeve 10, the bolt 3, and the container 1. A second sleeve, or stuffing box 13 surrounds the first sleeve 10, and is formed with an outwardly facing flange. The stuffing box 13 is preferably made of rubber or similar elastic material, and is of a generally cylindrical shape.

The outer diameter of the stuffing box 13 equals approximately the diameter of the opening formed in the sound-isolation layer; the stuffing box fits tightly to the sound-isolation layer because of the elasticity of its material. The inner diameter of the stuffing box 13 exceeds however the outer diameter of the sleeve 10, so that the sleeve 10 can move therein with some play. The length of the stuffing box 13 exceeds slightly that of the sleeve 10. Between the sleeve 10 and the stuffing box 13 on one side, and a nut 15 threaded on the bolt 3, there are disposed elastic means, such as outwardly convex washers 14 of the Belleville type, which can be pressed towards one another by the nut 15; the bolt 3 and the nut 15 together constitute fastening means so as to generally fasten the sound isolating layers 4, 5, 6, 7 and 8 to the container 1 with the aid of the sleeves 10 and 13, and the washers 14.

When the nut 15 is tightened, or rotated inwardly, the washers 14 abut both the sleeve 10 and the stuffing box 13, and compress the stuffing box 13 axially. The sleeve 10 in turn presses on the ring 12, which results in a tight fit between the bolt 3 and the container 1. When the stuffing box 13 is deformed by contact with the inner washer 14, a tight fit is formed between the stuffing box 13 and the washers 14 on one hand, and the container 1 on the other hand, thus in effect sealing off the passage or opening existing between the sleeve 10 and the bolt 3. In this manner both the sound-isolation layer, and the container 1 are protected from contaminants in the surroundings, while the entire aforedescribed structure is kept in place. If the nut 15 is loosened, the structure is maintained in place by other similar nuts, and in fact several nuts 15 can be loosened, provided the remaining number of nuts 15 threaded on tightly are sufficient to keep the structure in place. It is also possible to shift several bolts 3 inwardly in order to change a protective lining element 2, while the ring 12 and even the sleeve 10 can stay in place.

For a more complete disassembly the entire sound-isolation structure can be held together by encircling rings 16, of which only a portion is shown in the single FIGURE of the drawing. In such a case the sleeve 10, the ring 12, as well as the bolt 3, can be removed. The stuffing box 13, however, stays in place during such maintenance, as it is protected during such maintenance operations. The sleeve 10 can be replaced without any difficulties, as the device has been constructed purposely to allow a clearance between the stuffing box 13 and the sleeve 10 when the stuffing box 13 is not compressed. A protective (non-illustrated) cover of sound-isolation material is emplaced on the nut 15 after it has been tightened.

An installation of a grinder equipped according to the present invention was installed in a typical cement plant. It was found that the noise level was lowered by about 15 to 20 decibels, and after several operations, the tightness of the container 1 was excellent at the level of the tightening bolt 3; and the sound-isolation layer showed no trace of having been affected by atmospheric contaminants.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. In a particle grinder apparatus including a rotatable container for crushing materials inserted therein, the improvement comprising:

said container having at least one opening in a wall thereof, sound insulation means covering a major portion of the exterior surface of the wall of said container, elongated fastening means including an elongated stationary part and a movable part engaged thereon, said elongated part passing through said opening and through said sound insulation means and being operable for fastening said sound insulation means to said container, a first sleeve at least partially surrounding said elongated fastening means within a region adjacent said opening, a resilient second sleeve at least partially surrounding said first sleeve and including external flanges, said sound insulation means abutting said flanges of said second sleeve, resilient sealing means disposed around a portion of said elongated part of the fastening means, and between said first sleeve and said container, and elastic means disposed between said sleeves and said movable part of said fastening means, whereby, upon said movable part being tightened on said elongated part, said second resilient sleeve is compressed substantially in an axial direction by said elastic means, thereby establishing at least partial contact between an exterior peripheral portion of said first sleeve and an interior peripheral portion of said second sleeve, and sound-proofing said opening.

2. A particle grinder apparatus as claimed in claim 1, wherein said elongated part of said fastening means is a bolt, and said removable part is a nut.

3. A particle grinder apparatus as claimed in claim 1, wherein said elastic means includes first and second outwardly convex washers juxtaposed with, and abutting one another, one of said washers being arranged to abut operatively against said sleeves.

4. A particle grinder as claimed in claim 1, wherein said second sleeve includes a flange portion facing said elastic means.

5. A particle grinder apparatus as claimed in claim 1, wherein said first sleeve has an inwardly facing bevelled portion adjacent said resilient sealing means.

6. A particle grinder apparatus as claimed in claim 1, wherein said container is metallic.

7. A particle grinder apparatus as claimed in claim 1, further comprising a lining on the interior of said container.

* * * * *